United States Patent [19]

Griffith et al.

[11] 4,405,380

[45] Sep. 20, 1983

[54] HIGH STRENGTH, LOW ALLOY STEEL WITH IMPROVED SURFACE AND MECHANICAL PROPERTIES

[75] Inventors: Cecil B. Griffith, North Royalton; Jerry D. Thomas, North Olmsted; Dionisyj W. Demianczuk, Parma; John K. Abraham, Broadview Heights; Joseph E. Franklin, Medina, all of Ohio

[73] Assignee: Republic Steel Corporation, Cleveland, Ohio

[21] Appl. No.: 280,914

[22] Filed: Jul. 6, 1981

Related U.S. Application Data

[63] Continuation of Ser. No. 105,735, Dec. 20, 1979, abandoned.

[51] Int. Cl.[3] ..... C22C 38/12

[52] U.S. Cl. ..... 148/2; 75/129; 148/12 F; 148/36; 148/39

[58] Field of Search ..... 148/2, 12 F, 12.1, 36, 148/31.5, 39; 164/56, 57, 96, 133; 75/123 J, 123 M, 129

[56] References Cited

U.S. PATENT DOCUMENTS

| | | | |
|---|---|---|---|
| 2,389,516 | 11/1945 | Kinnear | 164/96 |
| 3,414,042 | 12/1968 | Behrens et al. | 164/57 |
| 3,556,866 | 1/1971 | Gibbs et al. | 148/2 |
| 3,593,774 | 7/1971 | Gribble et al. | 164/58 |
| 3,725,049 | 4/1973 | Satoh et al. | 75/123 J |
| 3,865,643 | 2/1975 | Bales et al. | 148/36 |
| 3,963,531 | 6/1976 | Elias et al. | 148/31.5 |
| 3,988,174 | 10/1976 | Kawano | 148/36 |
| 4,092,179 | 5/1978 | Charpentier et al. | 148/2 |
| 4,141,761 | 2/1979 | Abraham et al. | 148/36 |
| 4,142,922 | 3/1979 | Abraham et al. | 148/36 |

FOREIGN PATENT DOCUMENTS

| | | | |
|---|---|---|---|
| 50-81909 | 7/1975 | Japan | 148/2 |

OTHER PUBLICATIONS

*Metals Handbook,* 9th Edition, vol. 1, "Properties and Selection: Irons and Steels", 1978, pp. 112, 114–116, 556–560.

*Primary Examiner*—Peter K. Skiff

*Attorney, Agent, or Firm*—Cooper, Dunham, Clark, Griffin & Moran

[57] ABSTRACT

High strength, low alloy steel is produced, preferably as a hot rolled article (e.g. strip), to have a rimmed skin of essentially ferrite while having a main body or core which is aluminum-killed and comprises, for superior mechanical properties including yield strength, a suitable quantity of columbium and/or vanadium. The carbon, manganese and sulfur contents of the base metal, which provides the skin and plus the addition, the core, are preferably limited to provide special results as low alloy steel and also, by the same limitations, to provide auto sulfide shape control and thus to avoid unwanted directionality regarding toughness and bendability. The steel is made by pouring a mold 80-95% full of the base composition, then allowing the steel to rim for several minutes, and after a shell has solidified, continuing to pour while adding Al and Cb or V to the teemed stream, thereby providing an ingot with the above killed core, which can be hot reduced as desired.

18 Claims, No Drawings

HIGH STRENGTH, LOW ALLOY STEEL WITH IMPROVED SURFACE AND MECHANICAL PROPERTIES

This is a continuation, of application Ser. No. 105,735 filed Dec. 20, 1979, abandoned.

BACKGROUND OF THE INVENTION

This invention relates to high strength, low alloy steel products and methods of producing such products, the invention being more particularly related to hot rolled steel products of the stated character with improved mechanical properties, particularly in formability as by shaping, bending and like operations involving drawing strain in the metal or portions of it. Certain conventional HSLA steels, e.g. produced as hot rolled strip, have successfully included one or more micro-alloying ingredients such as columbium, vanadium and titanium, such steel being fully killed, i.e. usually aluminum-killed, and the strip or like article produced for use in as-hot-rolled condition having a yield strength in the range of about 50 ksi and above, indeed often as high as 80 or 90 ksi. In order to avoid directionality of results in forming processes such as bending and in impact strength, e.g. relatively poor transverse properties, so-called sulfide shape control agents have often been added, usually rare earth elements.

Although hot rolled, aluminum-killed products of the foregoing sort, sometimes with very low carbon (e.g. 0.06% or less) and including columbium or both columbium and vanadium for tensile properties and toughness, have been successful, it has been found that some difficulties nevertheless remain. For example, these hot rolled products have exhibited some limitations upon forming, notably bending, in that even though rare earths are added to minimize directionality or special chemistry is adopted for like purpose, cracking sometimes occurs, e.g. edge or other surface cracks, with small radius bends that are hoped to be possible at low carbon levels of steel.

In the case of some rimming grades of steel, particularly as designed for deep drawing operations in cold rolled state, i.e. after extensive cold rolling with appropriate annealing, problems of an apparently different sort have been noted and sought to be overcome. This rimming steel, which customarily is made with 0.07 to 0.11% carbon for convenience and economy in production, has superior drawing properties with a clean surface essential for cold rolled strip to be deep drawn or similarly formed, but manipulating or bending the strip or otherwise subjecting it to drawing or deforming operations has a tendency to fluting, and the steel has also exhibited the surface defects or markings known as stretcher strains. Other problems have been that the rimmed steel has some undesirable internal porosity and is subject to aging, i.e. so-called strain aging, which can also result in the stretcher strain markings mentioned above.

With the view of avoiding various difficulties in cold rolled drawing grades derived from rimmed steel, it has been proposed to prepare ingots using a rimming steel composition as described above, by first pouring each ingot mold to about 80% to 90% full of the molten steel, then interrupting such pour and allowing the mold to rest while rimming action occurs, e.g. for several minutes, and a skin or shell of rimmed steel solidifies adjacent to the mold wall. Thereupon pouring is continued, i.e. of the same steel from the same ladle, to fill the mold, while aluminum is added in sufficient amount to kill the entire, still-molten steel core. When the ingot solidifies, it consists of a rimmed steel skin or layer around and integral with a killed steel core, and can be processed by the usual steps of hot rolling, cold rolling, annealing and temper rolling as appropriate to achieve a cold rolled product of strip or the like suitable for drawing applications and retaining the rimmed surface over aluminum-killed steel. It is said that such products avoid the aging and porosity problems of previous rimmed steel, and may avoid the difficulties of the latter as to fluting and stretcher strains. In some such proposals for cold rolled, deep drawing products, addition of special elements such as columbium (for hardening or strengthening) and rare earths (for sulfide shape control) to the molten core have been described. In another case, it was proposed to fill the mold to about 65% with rimming (effervescing) steel of 0.08% C and 0.38% Mn, and after solidification of a shell, to complete filling with a killed steel, high carbon melt of 0.78% C, 0.80% Mn and 0.26% Si, said to yield a deep drawing product of high tensile strength, free of metalloid segregation.

None of this prior art, however, has indicated any significance for the class of steel now contemplated as high strength low alloy (HSLA) material with relatively quite low carbon content and designed for employment as a hot rolled product, e.g. hot rolled strip having sufficient levels of yield and impact strength, and bending properties, to be attractive for automotive uses where high strength with less weight has become important. Indeed, these HSLA steels inherently lack the problems, such as aging, porosity, or stretcher strains that have been noted with cold rolled, drawing grades of rimmed steel, but the above developments in the art have been noted because of their possible superficial resemblance, in some procedural steps, to some operations that are involved in the present invention and that have been discovered to have unexpected benefit for the special class of as-hot-rolled HSLA steel products.

SUMMARY OF THE INVENTION

The invention is predicated on the finding that significant improvement in such high strength, low alloy steel products, especially in the form of hot rolled strip or the like, is attainable by providing a cast ingot in which there is an outer layer or skin of rimmed steel derived, so to speak, from an HSLA chemistry that lacks additions both of aluminum or other deoxidizer and of micro-alloying elements such as columbium, vanadium and titanium. Thus the steel has a basic composition which is essentially 0.03 to 0.06% carbon, 0.2 to 0.6% manganese (or even less manganese, as not above 0.45%) with controlled contents of phosphorus and sulfur. All composition percentages herein are in weight percent. The products are made by pouring molten steel of this base composition into an ingot mold up to a filling level of 80% or more, e.g. between 80% and 90% and preferably about 85%. Teeming is interrupted and the effervescent rimming action which characterizes this basic melt is allowed to proceed, as for at least one minute, preferably from two to five minutes or even more (depending upon conditions), until a shell or skin next to the mold wall has solidified, as to a thickness of 1 to 4 inches. Then pouring is resumed, preferably with simultaneous addition of solid material such as aluminum in the form of pure aluminum or ferro-aluminum, and columbium and/or vanadium and/or titanium, which can also be added in the form of ferro-alloys, up to the desired amounts as explained below.

The operation of back-filling the mold, i.e. completing the filling in the manner stated, not only causes the aluminum and the stated alloying element or elements to mix into the molten core of the partly cast ingot, but also effectuates the killing of such metal with the aluminum, whereby the completed and completely poured ingot consists of an aluminum-killed core having the first-defined composition basic to HSLA steel plus the aluminum content and the aluminum-deoxidized condition, and also plus the critically significant mechanical properties imparted to this low-C, low-Mn composition by the stated content of columbium, vanadium or the like. As will be understood, suitable technique may be employed to retard solidification of the molten steel now remaining in the mold, for instance by applying a topping compound or by employing a so-called hot-top, the first or partial filling having been interrupted at or below the lower boundary of such structure. The ingot is then allowed to solidify in accordance with ordinary killed steel practice.

Ingots produced in this way are handled in conventional manner, being subject to usual operations before and after removal from the mold, including hot mill operations that employ hot rolling conditions known to be appropriate for steel having the composition finally reached in the ingot core. Thus the steel can be subjected to conventional hot deformation to produce plate, bar, sheet or strip, most commonly hot rolled strip as in thickness from about 0.05 to 0.5 inch. As stated, the conditions of hot rolling and of cooling and coiling the product are as can be found satisfactory for hot rolled steel having the composition of the ingot core in the present invention. Examples of such hot rolling practice are to be found, for instance, in Abraham et al. U.S. Pat. No. 4,142,922, granted Mar. 6, 1979. It is found that the present invention is greatly superior in avoiding surface cracks or nucleation of cracks during processing operations. In the first place, the so-called panel cracks or snakes, which have been found to be created in the surface of previous hot rolled HSLA steel by the presence of both columbium and aluminum, do not appear in the essentially pure ferrite surface of the present products. Hence, there is no need to undertake costly operations of grinding or the like, for significant metal removal to obliterate panel cracks and to achieve strip having a suitable surface.

It is further found that the hot rolled products of the invention not only have tensile properties in the range of 45 ksi yield strength and above, preferably 50 ksi or higher (the minimum value obtained being dependent on the content of the alloying elements such as columbium and vanadium, as detiled below), but have unusal properties for formability, especially in bending. Not only may the hot rolled strip, if desired, be made to lack the undesirable directionality that sometimes characterizes toughness and bendability in HSLA steels lacking sulfide shape control elements, but the actual suitability for bending or like shaping without cracking is materially higher than in prior HSLA products of otherwise similar chemistry.

As will now be understood, when the ingot of this invention or a bloom or slab from it is reduced by hot rolling, the article in effect retains the same rimmed shell or skin that characterized the ingot on solidification. In other words, the ultimate rolled product, such as strip 0.05 to 0.3 inch thick, has a thin skin at its principal surface (i.e. consisting of both sides) which is in effect rimmed steel, essentially lacking aluminum and oxidized aluminum compounds as well as other alloying ingredients; it is essentially ferrite, and is believed to contribute unusal results in the use of the product. In particular, this surface or surface layer of the present steel product is found to have greatly reduced tendency to surface notches, cracks or the like and tends to a reduced occurrence, indeed absence, of such cracks that might be expected to arise on sharp bending or similarly severe forming operations. This is in contrast to the situation when such bending or forming is attempted with many steel products, where there are often some fine cracks or surface inclusions that result in nucleation of more significant cracks or lines of fracture, which cannot be tolerated in the finished part that requires the bent or similarly formed shape.

Thus in a special sense, the invention provides unusual avoidance of the development of cracks on bending. Not only are there no oxidation products (e.g. resulting from killing) at the surface such as ordinarily afford some potential for crack nucleation, but the skin, being a low strength ferrite composition, has a substantially higher fracture strain characteristic than the underlying, high strength core. Hence, when the strip is bent, stretching or drawing an outermost layer of the steel, plastic deformation can be more readily achieved in such layer, avoiding development of cracks or the like. Under these circumstances, severe stresses (which involve localized drawing strains) can be applied to the product while avoiding development of cracks, which ordinarily tend to nucleate in the surface, and yet the major part of the product, being the high strength core, is properly capable of bending while sheathed, so to speak, from any surface tendency to develop fractures or cracks.

At the same time, these steel products are characterized by the high strength levels which are now known for HSLA steels of columbium- and/or vanadium-containing composition, and can also be characterized by what might be called auto-sulfide-shape control in the sense of being capable of having a special composition that precludes any need for rare earth additions or the like in order to avoid poor properties of bendability or toughness in the transverse direction as compared with the longitudinal direction, these being the directions related to rolling. In other words, with C and Mn at preferred low levels and S below 0.025%, the steel may be characterized by the advantages in the foregoing respect which are noted in the above-cited Abraham et al. U.S. Pat. No. 4,142,922.

Further details and examples of the invention are set forth hereinbelow.

DETAILED DESCRIPTION

The manner of producing the hot rolled steel articles of this invention, and indeed specifically advantageous compositions for such purpose, have been described above, at least to relatively close ranges for elements such as carbon and manganese. The base composition of the steel is essentially a low carbon chemistry suitable for HSLA steel, notably as distinguished from conventional rimmed steel compositions, which ordinarily contain carbon in the range of 0.07 to 0.11%, a carbon content which is particularly suitable for steel to be cast with rimming action, especially to take advantage of the desirably inexpensive practice of rimmed steel production where it is normally unnecessary and would indeed be deemed undesirable to adopt more costly treatments for achieving lower carbon values.

In contrast, the present invention is directed to a steel with carbon in the range of 0.03 to 0.06%, the last being an upper limit which also appears crucial for attainment of so-called auto-sulfide-shape control and thus avoidance of the use of rare earths or the like with their consequent expense and tendency to produce unwanted non-metallic surface inclusions.

The base metal may thus consist of the defined composition, with manganese in the range of 0.2 to 0.6%, very preferably not more than 0.45%, while the phosphorus concentration is at 0.045% maximum, and sulfur at 0.04% maximum, most particularly less than 0.025%, the balance being iron and incidental elements. This melt of steel, which is obtainable by appropriate procedure in a suitable furnace such as a so-called basic oxygen type furnace or one employing a similar process, is used in the first stage of the pouring of each ingot. That is to say, such metal held in the ladle is teemed into the ingot mold until the latter is, for instance, 85% full, the flow of molten steel being then interrupted. While similar partial filling is carried on with one or more further ingot molds, the first poured steel, which has been undergoing rimming action, freezes against the walls of the mold, thus yielding a solidified shell or skin, such action requiring from two to five minutes or more, possibly up to 15 minutes depending on thickness desired for the solid rimmed zone. This step is then immediately followed by final filling (back-filling) with further steel from the ladle (which is brought back for the purpose), while at the same time adding other desired elements, it being understood that the ladle can then be moved along for similar back-filling of further partly filled mold or molds that may be waiting.

Thus, solid aluminum is added (if desired, as ferro-aluminum) in an amount to kill the ingot core. Such amount is in the range of 0.02 to 0.20% final content of aluminum in the core, preferably 0.02 to 0.10%, a specific example being 0.05% aluminum. Likewise, along with the solid aluminum, other solid elements are added, e.g. at least one of the elements columbium and vanadium sufficient to provide amounts of 0.01 to 0.15% Cb and/or 0.03 to 0.20% V in the core. Thus, for example, if columbium is used alone as the additional alloying element, yield strength of 50 to 60 ksi requires 0.01 to 0.03% Cb; for 60 to 70 ksi, 0.04 to 0.07% Cb; for 70 to 80 ksi, 0.10 to 0.13% Cb; above 80 ksi, 0.14 to 0.15% Cb. If both columbium and vanadium are added, suitable amounts (likewise in the core) are: for 60 to 70 ksi yield strength, 0.02 to 0.04% Cb and 0.03 to 0.05% V, with a total Cb plus V of 0.05 to 0.08%; for 70 to 80 ksi, 0.02 to 0.04% Cb and 0.10 to 0.12% V, with a total Cb plus V of 0.12 to 0.14%; for greater than 80 ksi, 0.04 to 0.15% Cb and 0.10 to 0.20% V, total Cb plus V being at least 0.15%.

A convenient practice for addition of aluminum and other elements during the final filling of the mold in this invention is to make the addition as a special alloy of such elements with iron, prepared as fine particles, granules or other suitable solid pieces. In such alloy, the iron content may be as necessary (e.g. up to 70%), and the proportions of other elements, such as Al and Cb, are dependent on the amounts desired to be added, i.e. by using a predetermined quantity of the alloy. The alloy may also contain V and/or Mg, and other incidental elements. By way of example in such an alloy, suitable for injection, having iron up to 30%, the weight ratio of Al to Cb may advantageously be as follows:

| Desired Product Strength | (Wt. of Al)/(Wt. of Cb) Ratio Preferred | Range |
|---|---|---|
| 50–60 ksi | 2.6 | 1–12 |
| 60–70 ksi | 1.2 | 0.3–3.2 |
| 70–80 ksi | 0.54 | 0.15–1.3 |

For experimental test purposes, a commercial-size, 27-ton ingot was cast in accordance with the foregoing two-stage procedure, with a desired content of columbium, and was thereafter subjected to solidification and hot deformation in conventional manner, including hot rolling to a final gauge of the hot band, of 0.105 inch. The finish temperature of the hot band was 1600° F. and it was coiled at 1175° F. This strip product exhibited yield strengths, for various part of the coil, in the range of 52.6 to 55.6 ksi (longitudinal; 56 to 58 transverse) for a columbium content of 0.022%. The base composition of the steel was 0.05% C, 0.32% Mn, 0.007% P and 0.027% S. In addition to the above-noted Cb content, the aluminum-killed core of the ingot and of the hot rolled strip contained 0.045% Al. In all cases, superior formability was achieved, as evidenced by good bending with very minor or no edge cracks. Elongation (in 2 inches) was about 33% in each direction.

Although other evidence has indicated that with carbon not over 0.06%, manganese 0.2 to 0.6% and preferably not over 0.45% (as in the above steel) and sulfur below 0.025%, e.g. at 0.020% or less, effective auto-sulfide-shape control is attainable, and although the above test example of steel of the invention, with sulfur at 0.027%, did not exhibit complete sulfide shape control, this test steel showed good bendability. Thus even at a bend radius as small as ½T (0.05 inch), bending as much as 180° was achieved with only very minor edge cracks, being results superior to the bending characteristics of much currently available hot rolled, high strength low alloy steel without special sulfide shape control. Stated in another way, the best bendability of previous HSLA steel (without shape control) is often 2½ to 3T at T of 0.3 inch, whereas the new steel even with S at 0.025 to 0.027% can show bendability of about 2T at T of 0.3 inch.

The invention nevertheless is unusually effective as embodied with a composition to take advantage of its potential for auto-sulfide-shape control; in such case, all of the advantages of the present killed, HSLA steel with superior surface characteristics are fully realized. Such steel generally has a bending radius in each direction without cracks at least as low as 1T where T can be 0.3 inch.

As will be understood, an essential feature of the present invention, providing the pure ferrite skin or surface layer in the described products, is the two-stage pouring operation of the original ingot. As stated, the first filling of the ingot mold, to the extent of 80% to 95% (e.g. 85% to 90% or so), is allowed to incur rimming action, involving the usual boiling or similar effect, until a shell or skin is solidified. While it is difficult to measure the actual thickness of this shell, it appears that for optimum results for the ultimate hot rolled strip in the thickness ranges mentioned above, rimming action should proceed for a delay of 2 to 15 minutes, for example, preferably about 6 minutes, before the ingot mold is back-filled with additional ladle metal and with simultaneous injection of solid elements as mentioned above, particularly aluminum, and elements such as columbium, vanadium and titanium. Under these circumstances, the hot rolled strip (e.g. 0.1 to 0.5 inch thick) is found to have an essentially pure ferrite skin of 0.001 to 0.010 inch thickness over both faces, preferably at least about 0.003 inch.

As will be understood, techniques and devices are available for feeding particles, granules or other pieces of the added elements, e.g. aluminum or ferro-aluminum together with columbium or vanadium, or composite ferro-alloys, into the falling stream of molten steel or directly into the mold while the further steel of the melt is being delivered from the ladle. As will also be appreciated, the chief desirability is to get these elements incorporated not later than completion of back-filling.

Although aluminum is greatly preferred and has very special advantages as the deoxidant for providing the killed composition of the core steel, it is conceived that for some purposes the steel could be killed otherwise, as by silicon. To such extent in appropriate situations, silicon may thus be considered as an equivalent killing agent, and hence as an added ingredient of the ultimate steel core, in lieu of aluminum. It will, of course, be understood that silicon is not an element of normally desired inclusion in any steel to undergo rimming action, and would in no case be added except during the back-filling operation that creates the killed state of the core.

The steel products of this invention, in addition to properties of high strength and superior formability, have good weldability. The final rolled strip has an excellent surface, free of cracks, snakes and the like, and is very suitable for such finishes as plating, paint and enamel. The distribution of aluminum and particularly that of columbium have been found very good throughout the core metal of the ingot and rolled products, for the purposes desired. Variations in composition have been indicated, and variations are conceivable in method of production, as in the mode of adding further elements.

Thus instead of a single ferro-alloy, mixtures of ferro-alloys each of less than all elements can be used. Any such pieces, e.g. ferro-columbium granules and aluminum pellets, should be well mixed before being supplied to the equipment that injects the material into the back-filling stream of steel. Especially for the back-filling, the teeming nozzle should be relatively large. The steel in the ladle should be as hot as possible consistent with good rimming action. The delay time should be long enough to achieve a sufficient rimmed zone around the ingot for a significant ferrite skin at all critical surfaces of the products. The added elements or one or more of them could be formed as ferro-alloy wire or rod (e.g. by powder metallurgy), to be inserted in the teeming stream or in the molten metal in the mold. Thus in general the invention is capable of being carried out in various ways without departure from the present disclosure or its spirit.

The advantage of the invention, for example when made as hot rolled strip, as described above, with a base melt having the aforesaid preferred composition with not more than 0.06% C, 0.36% Mn, and less than 0.025% S (e.g. 0.017% S) and carrying the described ferrite skin over a core also containing Cb (0.028%) and Al (0.098%), has been demonstrated by tests to include bendability, without cracking, of essentially zero inside radius of bend over essentially 180°, for example, at strip thicknesses of 0.3, 0.4, and 0.5 inch, as contrasted with strip that was rolled to the same thicknesses from a billet of the same steel from which the ferrite skin had been ground away, and that shows cracking on such bending in all cases.

We claim:

1. A high strength steel product consisting of hot rolled strip having a thickness of 0.05 to 0.5 inch produced by hot rolling to a deformation of at least 50% and as so produced having a yield strength of at least 50 ksi and bendability, without cracking, of essentially zero inside radius of bend over essentially 180°, said product consisting of a skin of rimmed steel which is essentially ferrite and has a thickness of about 0.001 to 0.01 inch, over the principal surface area of the product and beneath said skin a core of aluminum-killed steel, the steel of said skin and core being free of sulfide shape control elements and consisting essentially of 0.03 to 0.06% C, 0.2 to 0.6% Mn, 0.045 max. % P, less than 0.025% S, balance iron and incidental elements, said core also containing the following elements: 0 to 0.20% Ti, 0.02 to 0.2% Al, 0.01 to 0.15% Cb and 0 to 0.20% V.

2. A steel product as defined in claim 1 in which said skin and core contain 0.015% max. % P and 0.015 max. % S, and up to 0.45% Mn.

3. A steel product as defined in claim 2, having yield strength of at least 80 ksi, said core containing at least 0.04% Cb and at least 0.10% V, the total of Cb and V in said core being at least 0.15%.

4. A steel product as defined in claim 2 in which said core contains at least 0.04% Cb.

5. A steel product as defined in claim 1 in which said core contains at least 0.04% Cb.

6. A steel product as defined in claim 1 in which said core contains at least 0.10% Cb.

7. A steel product as defined in claim 1 in which said core contains at least 0.14% Cb.

8. A method of making a hot rolled, high strength, low alloy steel product consisting of hot rolled strip having a thickness of 0.05 to 0.5 inch, comprising pouring an ingot mold 80% to 95% full of molten steel which is free of sulfide shape control elements and consists essentially of 0.03 to 0.06% C, 0.2 to 0.6% Mn, 0.045 max. % P, less than 0.025% S, balance iron and incidental elements, allowing said filling to undergo rimming action while a shell of rimmed steel about one inch to four inches thick solidifies next to the mold surround a still-molten core, and then completing pouring of said molten steel into said ingot mold while adding to the molten steel in the mold, aluminum to provide 0.02 to 0.20% Al in the finished core and thereby to kill said core, and 0.01 to 0.15% Cb and 0 to 0.20% V in the core; and after solidification of the ingot, converting the same by hot rolling, to a hot reduced strip product having a skin of rimmed steel which is essentially ferrite and has a thickness of about 0.001 to 0.01 inch, over the principal surface area of the product, and beneath the skin a core of aluminum-killed steel, said hot rolled strip product having bendability, without cracking, of essentially zero inside radius of bend over essentially 180°.

9. A method as defined in claim 8 in which the first-described pouring of steel is to about 85 to 90% of filling of the mold.

10. A method as defined in claim 8 in which the said addition to the molten steel core comprises aluminum and columbium in aforesaid amounts and is effected by adding portions of solid alloy consisting essentially of iron with aluminum and columbium in proportions required to provide said amounts of Al and Cb in the core.

11. A method as defined in claim 10 in which the final product is made to have a yield strength of at least 50 ksi, and the weight ratio of Al to Cb in said last-mentioned alloy is in the range of 1 to 12.

12. A method as defined in claim 20 in which said weight ratio is about 2.6.

13. A method as defined in claim 10 in which the final product is made to have a yield strength of at least 60 ksi and said introduced alloy contains Cb to provide at least 0.04% Cb in the ingot core, the weight ratio of Al to Cb in said alloy being in the range of 0.3 to 3.2.

14. A method as defined in claim 13 in which said weight ratio is about 1.2

15. A method as defined in claim 10 in which the final product is made to have a yield strength of at least 70 ksi and said introduced alloy contains Cb to provide at least 0.10% Cb in the ingot core, the weight ratio of Al to Cb in said alloy being in the range of 0.15 to 1.3.

16. A method as defined in claim 15 in which said weight ratio is about 0.54.

17. A method as defined in claim 9 in which the addition of columbium to the molten steel in the mold during completion of pouring is sufficient to provide at least 0.10% Cb in the ingot core.

18. A method as defined in claim 9 in which the additions to the molten steel in the mold during completion of pouring are aluminum to provide 0.04 to 0.10% Al columbium to provide 0.04 to 0.13% Cb and vanadium to provide 0.05 to 0.20% V in the ingot core.

* * * * *

UNITED STATES PATENT AND TRADEMARK OFFICE

CERTIFICATE OF CORRECTION

PATENT NO. : 4,405,380

DATED : September 20, 1983

INVENTOR(S) : CECIL B. GRIFFITH et al.

It is certified that error appears in the above-identified patent and that said Letters Patent is hereby corrected as shown below:

Col. 9, line 7, "20" should read --11-- .

Signed and Sealed this

*Twenty-second* Day of *January 1985*

[SEAL]

*Attest:*

DONALD J. QUIGG

*Attesting Officer* *Acting Commissioner of Patents and Trademarks*